US006428289B1

(12) United States Patent
Lishanski et al.

(10) Patent No.: US 6,428,289 B1
(45) Date of Patent: Aug. 6, 2002

(54) AUTOMATED PUMP

(76) Inventors: Grigori Lishanski, 10112 W. Sharon La., Milwaukee, WI (US) 53225; Oleg Lishanski, 805 Weidner Ct., Buffalo Grove, IL (US) 60089

( * ) Notice: Subject to any disclaimer, the term of this patent is extended or adjusted under 35 U.S.C. 154(b) by 0 days.

(21) Appl. No.: 09/745,755

(22) Filed: Dec. 21, 2000

(51) Int. Cl.[7] ..... F04B 17/00
(52) U.S. Cl. ..... 417/415; 417/413.2; 417/413.3
(58) Field of Search ..... 417/415, 44.1, 417/212, 413.2, 413.3, 416, 479, 480

(56) References Cited

U.S. PATENT DOCUMENTS 4,737,083 A * 4/1988 Meyer ..... 417/413
5,002,471 A * 3/1991 Perlov ..... 417/413
5,681,152 A * 10/1997 Ahs ..... 417/413.2
6,280,148 B1 * 8/2001 Zengerle et al. ..... 417/44.1
6,315,533 B1 * 11/2001 Lishanski et al. ..... 417/545

* cited by examiner

*Primary Examiner*—Charles G. Freay
*Assistant Examiner*—Michael K. Gray
(74) *Attorney, Agent, or Firm*—Boyle Fredrickson Newholm Stein & Gratz S.C.

(57) ABSTRACT

An automated pump including a pulse generator capable of altering the output volume of fluid flow produced by the pump. The present invention is a vibratory pump including a pulse generator connected to a vibratory generator on the pump that is used to selectively control the amount of vibration created by the vibration generator. By increasing or decreasing the amount of vibrations created by the vibration generator, an operator can control the fluid flow output of the pump to fit the desired use for the pump.

11 Claims, 2 Drawing Sheets

AUTOMATED PUMP

FIELD OF THE INVENTION

The invention relates to pumps and more specifically to vibratory pumps in which the flow output from the pump can be varied by varying the oscillation of a vibration generator connected to the pump.

BACKGROUND AND SUMMARY OF THE INVENTION

The present invention is a vibratory pump in which the outgoing flow from the pump can be altered by changing the oscillation of the vibration generator connected to the pump. The vibration generator moves a plunger within a housing for the pump, such that the plunger repeatedly contacts a flexible diaphragm also disposed within the pump housing. The repeated contact of the plunger with the diaphragm urges the liquid to be pumped through an opening in the diaphragm into an outlet chamber connected to the housing from which the liquid is discharged. The frequency at which the vibration generator operates can be varied by altering the operation of a pulse generator connected to the vibration generator. In this manner, the pump can supply as large or as little a fluid flow from the pump as necessary for the desired application.

BRIEF DESCRIPTION OF THE DRAWINGS

The following drawings currently illustrate the best mode contemplated of carrying out the invention.

In the drawings.

DETAILED DESCRIPTION OF THE INVENTION

Figure 1:
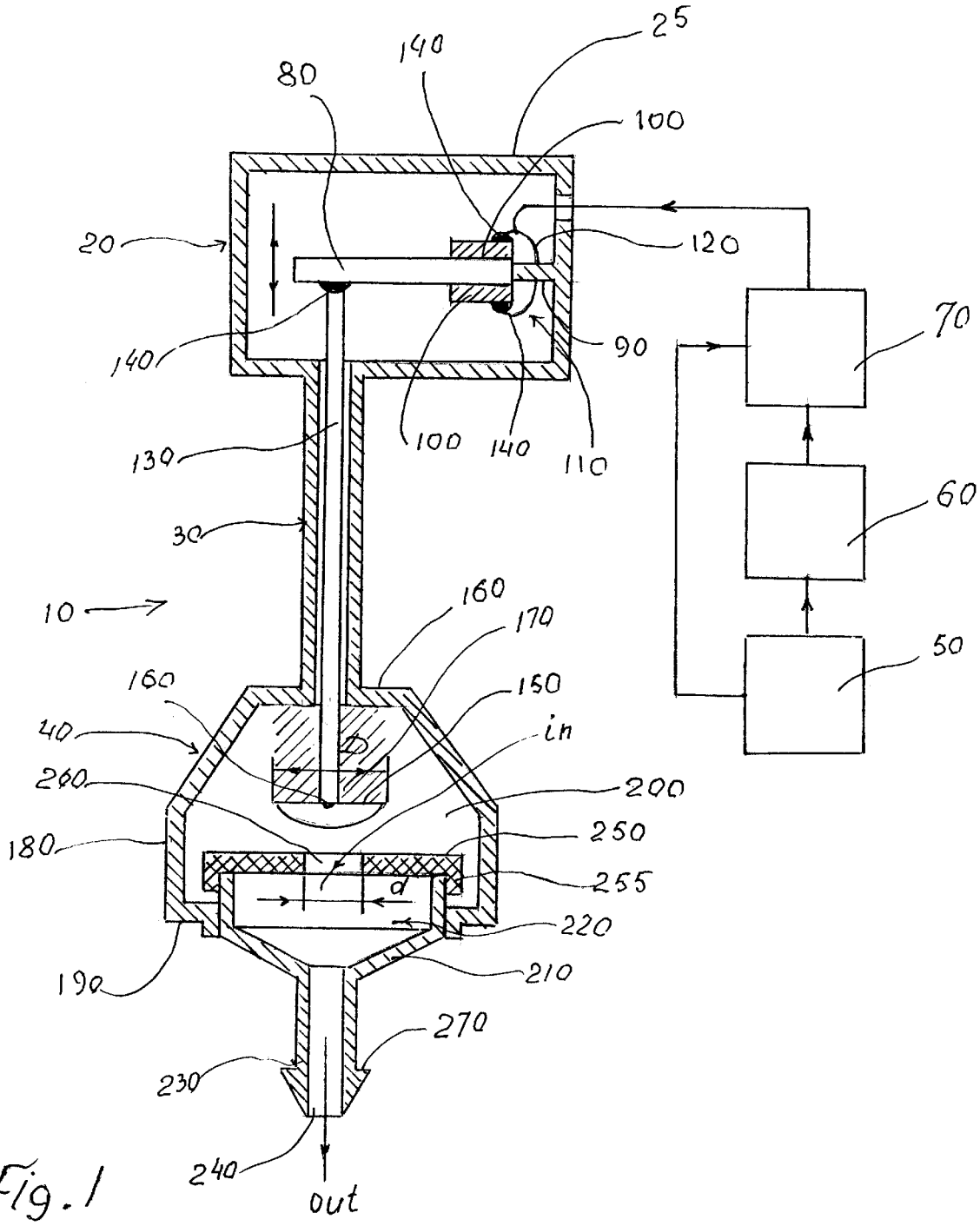
FIG. 1 is a cross-sectional view of an automated vibrating pump constructed according to the present invention.

With reference now to the drawing figures in which like reference numerals describe like parts throughout the disclosure, an automated pump is indicated generally at 10 in FIG. 1. The pump 10 includes a vibration generator 20 connected by a shaft 30 to a pump housing 40 that are formed from a rigid material, such as hard plastic. The vibration generator 20 enclosed within an enclosure 25 and is operatively connected to a power supply 50, a pulse generator 60 and an amplifier 70, which, in turn, are connected in series with the amplifier 70 connected directly to the vibration generator 20 through an aperture 75 in the enclosure 25. The vibration generator 20 consists of a piezo electric element 80 that is fixed at one end to a stationary platform 90 located within the vibration generator 20. Adjacent the platform 90, a pair of electrodes 100 are disposed on either side of the piezo electric element 80 and form a circuit 110 with a wire 120 that is operably connected to each of the electrodes 100 and to the amplifier 70.

Opposite the platform 90, the piezo electric 80 is connected to a rod 130 by an amount of an adhesive 140, or other suitable securing means. The rod 130 extends downwardly from the vibration generator 20 through the shaft 30 and into the pump housing 40. The shaft 130 may be made of any suitable rigid material, such as a plastic or metal.

Opposite the piezo electric element 80, the rod 130 is connected to a plunger 150. The plunger 150 is generally circular in shape, has a diameter D and can be formed of any suitable rigid or semi-rigid material, such as a plastic or hard rubber. The plunger 150 is secured to the rod 130 by the insertion of a knob 160 extending from the rod 130 that is received within an aperture 170 in the plunger 150. Alternatively, the plunger 150 can be secured to the rod 130 by other suitable means such as adhesives, screws extending through the plunger 150 into the rod 130 and the like.

The plunger 150 is retained within the plunger housing 40. The plunger housing 40 includes a number of wall sections 180 that extend downwardly from the lower end of the shaft 30 and are connected to a base 190 opposite the shaft 30. The wall sections 180 partially enclose the housing 40 and define openings 200 therebetween.

The base 190 further includes an outlet chamber 210 disposed in the center of the base 190. The outlet chamber 210 is generally circular in shape and can be formed separately from or formed integrally with the base 190. The outlet chamber 210 includes an open end 220 disposed within the housing 40 adjacent the plunger 150 and an outlet nozzle 230 extending away from the housing 40 opposite the open end 220. The nozzle 230 defines a passage 240 that is in fluid communication with the interior of the outlet chamber 210. A flexible diaphragm 250 covers the open end 220 of the outlet chamber 210. The diaphragm 250 includes a central, circular opening 260 which has a diameter d and a downwardly depending circumferential flange 255 that engages the exterior of the outlet chamber 210.

A hose (not shown) can be secured to the nozzle 230 by frictional engagement with a circumferential ridge 270 disposed on the nozzle 230 in order to direct the outcoming fluid flow from the outlet chamber 210 through the nozzle 230 and through the hose.

In operation, the automated pump 10 is positioned partially within the fluid to be pumped such that the pump housing 40 is completely submerged beneath the surface of the fluid. The power supply 50 is then activated such that the piezo electric element 80 begins to vibrate opposite the platform 90, thereby oscillating the rod 130 in a vertical direction. As the rod 130 and plunger 150 move in a downward direction, the plunger 150 urges fluid located beneath the plunger 150 through the opening 260 in the diaphragm 250 and into the outlet chamber 210. When the plunger 150 contacts the diaphragm 250, because the plunger 150 has a diameter D greater than the diameter d of the opening 260, the plunger 150 prevents any further fluid flow into the outlet chamber 210. Due to the flexibility of the diaphragm 250, he plunger 150 also urges the fluid outwardly through the nozzle 230 when the plunger 150 contacts the diaphragm 250 by pressing downwardly on the diaphragm d 250 and compressing the fluid contained within the outlet chamber 210.

When the rod 130 and plunger 150 stop moving downwardly and begin to move upwardly due to the oscillation of the piezo electric element 80, the upward movement of the plunger 150 creates a slight vacuum between the plunger 150 and the diaphragm 250. This vacuum draws fluid from the exterior of the plunger housing 40 through the openings 200 and into the space vacated by the plunger 150. The incoming fluid further urges the fluid contained within the outlet chamber 210 outwardly through the nozzle 230. The pumping of the fluid in this manner continues until the power supply 50 is turned off, ceasing the vibration of the piezo electric element 80.

Due to the presence of a pulse generator 60 connected in series between the power supply 50 and the piezo electric element 80, the vibrations of the piezo electric element 80 can be controlled by varying the pulse supplied from the pulse generator 60 to control the output of the pump 10. For applications needing a large volume of fluid, increasing the number of pulses output by the pulse generator 60 increases the number of oscillations of the element 80, consequently increasing the fluid flow through the pump 10. Alternatively, if the application requires only a small amount of fluid, the pulse generator 60 can be adjusted to reduce the number of vibrations of the piezo electric element 80, consequently reducing the fluid output of the pump 10.

Figure 2A:
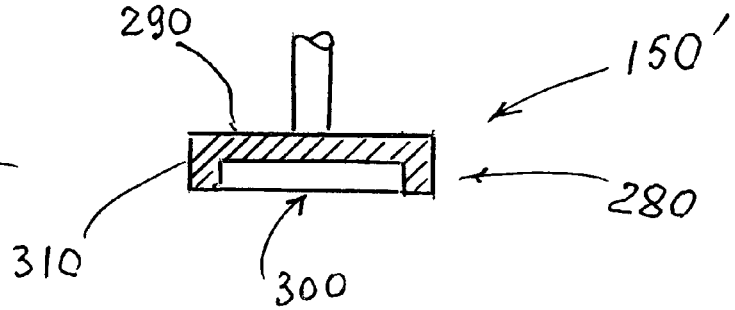
FIGS. 2A–B are cross-section views of alternative constructions for a plunger utilized with the pump of FIG. 1.
Figure 2B:
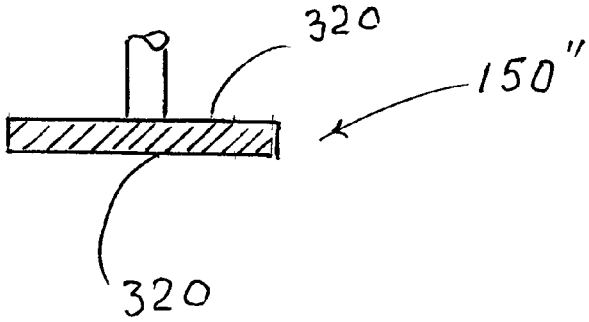

The output of the pump 10 can also be varied by the use of plungers 150 having various configurations, as shown in FIGS. 2A–2B. A first variation for the plunger 150 is the plunger 150' in FIG. 2A. This plunger 150' is formed as a generally hollow cylinder 280 having a closed end 290, an open end 300 opposite the closed end 290, and a circumferential flange 310 adjacent the open end 300. The closed end 290 is attached to the rod 130 such that the open end 300 faces the diaphragm 250. When the plunger 150' moves downwardly due to the oscillation of the piezo electric element 80, fluid fills the interior of the plunger 150', reducing the mount of fluid urged downwardly by the plunger 150', decreasing the compressive force exerted on the diaphragm 250 and resulting in a reduced fluid flow through the nozzle 230.

A second embodiment for the plunger is shown in FIG. 2B at 150". In this embodiment, the plunger 150" is formed as a circular disk formed of a rigid material having one of the two opposite faces 320 secured to the rod 130. The plunger 150" creates a greater compressive force on the diaphragm 250 than the plunger 150', but less than that of the plunger 150 to provide a mid-range amount of fluid flow through the nozzle 230.

Various alternatives and embodiments are contemplated as being within the scope of the following claims particularly pointing out and distinctly claiming the subject matter applicant regards as the invention.

We claim:

1. An automated pump comprising:

a vibration generator connected to a variable pulse generator and a power supply;

a pump housing connected to the vibration generator, the housing including at least one fluid opening, an outlet nozzle in fluid communication with the at least one fluid opening and a diaphragm having an aperture, the diaphragm disposed between the at least one fluid opening and the outlet nozzle;

an elongate member connected to the vibration generator and extending between the vibration generator and the pump housing, the member including a plunger disposed within the housing an selectively engageable with the diaphragm; and an outlet chamber directly connected to said aperture of said diaphragm, said outlet chamber connecting directly to said outlet nozzle.

2. The pump of claim 1 wherein the vibration generator further includes a piezo electric element connected to the elongate member.

3. The pump of claim 1 wherein the plunger is convex in shape.

4. The pump of claim 1 wherein the plunger is concave in shape.

5. The pump of claim 1 wherein the plunger is flat.

6. The pump of claim 1 wherein the plunger is made of a semi-rigid material.

7. The pump of claim 1 further comprising an amplifier connected to the vibration generator and the pulse generator.

8. The pump of claim 1 wherein the pump housing is formed of a rigid material.

9. A method for pumping a fluid comprising the steps of:

providing a pump including a vibration generator connected to a power supply and a pulse generator, the vibration generator connected to a pump housing spaced from the vibration generator and including at least one fluid opening, an outlet nozzle in fluid communication with the at least one fluid opening and a diaphragm having a fluid aperture, the diaphragm disposed between the at least one fluid opening and the outlet nozzle, an outlet chamber being directly connected to said aperture of said diaphragm, said outlet chamber connecting directly to said outlet nozzle;

providing an elongate member connected at one end to the vibration generator and having the other end disposed within the pump housing;

providing a plunger disposed on the elongated member opposite the vibration generator within the pump housing;

placing the pump housing and plunger beneath the surface of a volume of the fluid to be pumped; and supplying the power from the power supply to the vibration generator to oscillate the elongate member and rod within the pump housing.

10. The method of claim 9 further comprising the step of altering a pulse provided by the pulse generator to increase the vibrations supply by the vibration generator.

11. The method of claim 9 further comprising the step of altering a pulse provided by the pulse generator to the vibration generator to decrease the number of vibrations produced by the vibration generator.

* * * * *